US009016811B2

(12) United States Patent
Raunikar

(10) Patent No.: US 9,016,811 B2
(45) Date of Patent: Apr. 28, 2015

(54) APPARATUS FOR CONCEALING HOUSEHOLD OBJECTS

(71) Applicant: Sportin Wood Inc., West Melbourne, FL (US)

(72) Inventor: Anthony Raunikar, Melbourne, FL (US)

(73) Assignee: Concealment Solutions Inc., Melbourne, FL (US)

( * ) Notice: Subject to any disclaimer, the term of this patent is extended or adjusted under 35 U.S.C. 154(b) by 0 days.

(21) Appl. No.: 13/959,092

(22) Filed: Aug. 5, 2013

(65) Prior Publication Data

US 2015/0035423 A1 Feb. 5, 2015

(51) Int. Cl.

| | |
|---|---|
| ***A47B 46/00*** | (2006.01) |
| ***A47B 88/18*** | (2006.01) |
| ***A47B 88/04*** | (2006.01) |

(52) U.S. Cl.

CPC ..... *A47B 88/18* (2013.01); *A47B 88/04* (2013.01)

(58) Field of Classification Search

USPC ..... 312/204, 221, 212, 215, 249.7, 298, 312/309–311, 322, 242; 108/25, 26

See application file for complete search history.

(56) References Cited

U.S. PATENT DOCUMENTS

| | | | | |
|---|---|---|---|---|
| 1,345,194 | A * | 6/1920 | Johnson | 312/204 |
| 2,492,697 | A * | 12/1949 | Higley | 312/322 |
| 3,331,645 | A * | 7/1967 | Vercellotti | 312/248 |
| 3,485,544 | A * | 12/1969 | Beckerman | 312/248 |
| 5,238,358 | A * | 8/1993 | Higgins et al. | 414/463 |
| 5,329,865 | A * | 7/1994 | McWard | 109/50 |
| 5,407,261 | A * | 4/1995 | Mercer | 312/248 |
| 6,357,842 | B1 * | 3/2002 | Nott et al. | 312/248 |
| 8,136,897 | B2 * | 3/2012 | Mascari | 312/242 |
| 2006/0290248 | A1 | 12/2006 | Chandler | |
| 2010/0007253 | A1 * | 1/2010 | Ryerson | 312/247 |
| 2013/0206042 | A1 * | 8/2013 | Mohammed | 108/26 |

* cited by examiner

*Primary Examiner* — Daniel Rohrhoff

(74) *Attorney, Agent, or Firm* — Kelly G. Swartz

(57) ABSTRACT

The invention is a device for concealing personal items comprising a release, a pivot, a drawer cradle, and a support. The pivot is fixedly connected to the support and rotatably connected to the drawer cradle. The drawer cradle may be in an activated position or a deactivated position. When the release is activated gravity operates to rotate the drawer cradle about the pivot.

15 Claims, 3 Drawing Sheets

APPARATUS FOR CONCEALING HOUSEHOLD OBJECTS

FIELD OF THE INVENTION

The present invention relates to the field of concealment furniture. More specifically, the present invention relates to table-like structures that include drawers that are not readily visible to the casual observer.

BACKGROUND OF THE INVENTION

The present Invention is directed towards furniture which incorporates hidden storage with quick access to the storage provided by a hidden release mechanism that allows the hidden drawer to extend from beneath the furniture. There is an ongoing need for storage volumes in order to store valuable or sensitive items. Existing systems for storing such items typically provide storage that is readily apparent to the casual observer or cumbersome to access. Many individuals would like the security of concealed storage coupled with the ease of rapid access and the attractiveness of conventional furniture. This may be particularly beneficial to individuals storing guns and other weapons.

A need exists, therefore, for a device which allows for the discreet storage of items and easy, fast access to those items while maintaining an attractive appearance desirable in home living areas.

SUMMARY OF THE INVENTION

With the foregoing in mind, embodiments of the present invention are related to a device that may be incorporated into a piece of furniture and conceal the existence of a storage area.

According to an embodiment of the present invention, a device for concealing personal items is described. A release may be attached to a table skirt, table apron, tabletop, or the like. In some embodiments, the table skirt, table apron, tabletop, or the like may comprise the release. The release may retain a drawer cradle in a deactivated position until the release is activated. In the deactivated position, the drawer cradle may be concealed by the tabletop, table skirt, table apron, or the like. In the deactivated position, the drawer cradle may be substantially parallel to the ground or to the table skirt, table apron, tabletop, or the like. When the release is activated, gravity may operate on the drawer cradle to move it to an activated position. In the activated position, the front of the drawer cradle may be further from the tabletop, table skirt, table apron, or the like than the back of the drawer cradle. The drawer cradle may be released by activation of the release to provide access to the contents of the drawer cradle.

When the release is activated, the weight and position of the drawer cradle may cause it to rotate about a pivot. The pivot may be fixedly secured to a support, and the drawer cradle may be secured to the pivot in such a way that the drawer cradle may rotate about the pivot.

The device may also comprise a dampener. The dampener may be connected to a structure, which may be connected to, and span, the drawer cradle. When the drawer cradle moves to the activated position and the drawer is extended, the back side of the drawer, or an attachment to the drawer, may come into contact with the dampener to prevent further forward motion of the drawer.

In one embodiment of the device for concealing personal items, the upper end of an articulating arm may be connected to a support. A table skirt, table apron, tabletop, or the like may comprise the support. The lower end of an articulating arm may be connected to the drawer cradle. The release may maintain the drawer cradle in the deactivated position. When the release is activated, gravity, or the weight or position of the device may operate to swing the drawer cradle into the activated position. When in the activated position, the drawer may extend away from the drawer cradle to provide access to the contents of the drawer.

A drawer may be located within the drawer cradle. An outside drawer slide may be securely connected to the inner portion of the drawer cradle. This outside drawer slide may interlock with an inside drawer slide that may be connected to the drawer. The inside drawer slide may be secured to the drawer. The interconnection of the inside drawer slide and the outside drawer slide may allow the drawer to move laterally with respect to the drawer cradle. This movement may allow the drawer to move into and out of the drawer cradle. When the drawer cradle is in the activated position, the drawer may be extended away from the drawer cradle. When the drawer cradle is in the deactivated position, the drawer may be retracted into the drawer cradle.

The drawer may extend beyond the drawer cradle to provide access to articles contained within the drawer when the drawer is in the activated position.

In one embodiment of the release there may be a latch that has a latch release. When the latch release is activated, the latch may release the drawer cradle and allow the drawer cradle to move into the activated position. A user triggering an actuator may cause the actuator to activate the latch release. When the latch release is activated, the latch may move to a position that releases the drawer cradle and allows the front side of the drawer cradle to move away from the release.

The actuator may be an elongated member. In such an embodiment, the actuator may have an actuator pivot end and an actuator trigger end. The actuator may be connected at the actuator pivot end to an actuator guide at the actuator guide pivot end of the actuator guide. The actuator guide may be an elongated member with a channel disposed down the length of the actuator guide. The actuator may be an elongated member with a protrusion that fits within the channel of the actuator guide. The latch may be disposed on the actuator guide such that when the actuator trigger end is moved toward the actuator guide, the latch release is depressed causing the latch to release the drawer cradle and allowing the drawer cradle to move into the activated position. The drawer cradle may be returned to the deactivated position by moving the drawer cradle toward the latch and causing the latch to catch the drawer cradle.

The actuator may be attached to the actuator guide in a configuration that allows the protrusion to enter the channel when the actuator trigger end is depressed toward the actuator guide. The height of the actuator guide may be shorter at the trigger end than it is at the actuator guide pivot end. This may allow the outer sides of the actuator guide and actuator to be substantially parallel to one another when the release is in its nominal, deactivated position while allowing the actuator to come into contact with and activate the latch release when the actuator trigger end is depressed. When the actuator trigger end is depressed, the actuator may pivot about the connection to the actuator guide pivot end. In some embodiments, the protrusion height may be shorter at the actuator trigger end than at the actuator pivot end. The height differences in the actuator and actuator guide ends may be gradual and decrease substantially linearly from one end of the device to the other.

In some embodiments of the device for concealing personal items, the device may be incorporated into a table, night stand, bookshelf, chest, dresser, or the like. In such an embodiment, a table apron may include trim pieces that are viewable to the casual observer of the table. One or more of the trim pieces may be utilized as the actuator. In such an embodiment, the actuator may be located to the side or rear of the device preventing a user standing in front of the actuator when depressing from being struck by the drawer or the drawer cradle when the device moves to the activated position. In other embodiments, the actuator may be located on the front of the device.

In one embodiment of the invention, there may be a pair of articulating arms on either side of the drawer cradle. Each articulating arm may be connected to a support at one end and the drawer cradle at the other end.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
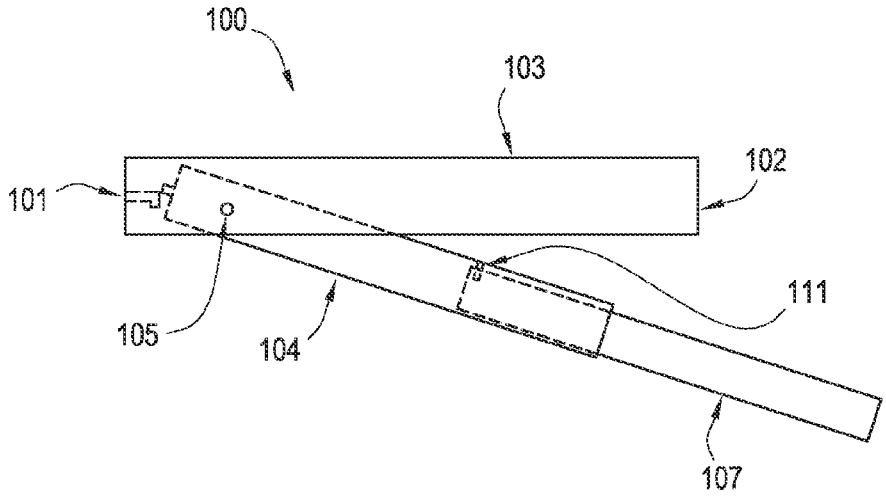
FIG. 1 depicts one embodiment of the inventive concept.

Referring to FIG. 1, a device for concealing personal items 100 is shown. A release 101 may be attached to a table skirt, table apron 102, tabletop 103, or the like. In some embodiments, the table skirt, table apron 102, tabletop 103, or the like may comprise the release. The release 101 may retain a drawer cradle 104 in a deactivated position until the release 101 is activated. In the deactivated position, the drawer cradle 104 may be concealed by the tabletop 103, table skirt, table apron 102, or the like. In the deactivated position, the drawer cradle 104 may be substantially parallel to the ground or to the table skirt, table apron 102, tabletop 103, or the like. When the release 101 is activated, gravity may operate on the drawer cradle 104 to move it to an activated position, as depicted in FIG. 1, in which, the contents of the drawer 107 may be accessible. In the activated position, the front of the drawer cradle 104 may be further from the tabletop 103, table skirt, table apron 102, or the like than the back of the drawer cradle 104. The drawer cradle 104 may be released by activation of the release 101 to provide access to the contents of the drawer cradle 104.

In some embodiments, when in the deactivated position, the drawer cradle 104 may be beneath a tabletop. In some embodiments, when in the deactivated position, the drawer cradle 104 may be surrounded by a table skirt, table apron 102, or the like. In some embodiments, the height of the table skirt, table apron 102, or the like may be greater than the height of the drawer cradle 104. The height of the table skirt, table apron 102, or the like may be greater than the height of the device for concealing personal items 100.

When the release 101 is activated, the weight and position of the drawer cradle 104 may cause it to rotate about a pivot 105. The pivot 105 may be fixedly secured to a support. The pivot 105 may also be connected to a table apron 102. The drawer cradle 104 may be secured to the pivot 105 in such a way that the drawer cradle 104 may rotate about the pivot 105. The drawer cradle 104 may rotate so that the front of the drawer cradle 104 is visible or accessible in front of or beneath the table when the release 101 is activated. The pivot 105 may be located on the outside of the drawer cradle 104. In such an embodiment, the pivot 105 may be attached to the side of the drawer cradle 104, behind the midpoint of the drawer cradle 104.

The device 100 may also comprise a dampener 111. The dampener 111 may be connected to the drawer cradle 104. In such an embodiment, the dampener 111 may be connected to a structure spanning above the drawer cradle 104. When the drawer cradle 104 moves to the activated position, and the drawer 107 is extended, the back side of the drawer 107, or an attachment to the drawer 107, may come into contact with the dampener 111. The drawer cradle 104 may contact the tabletop 103 to limit the range of motion of the drawer cradle 104 about the pivot 105. The drawer 107 may come into contact with the dampener 111 to limit the range of motion of the drawer 107 with respect to the drawer cradle 104. The dampener 111 may be a shock absorber.

Figure 2:
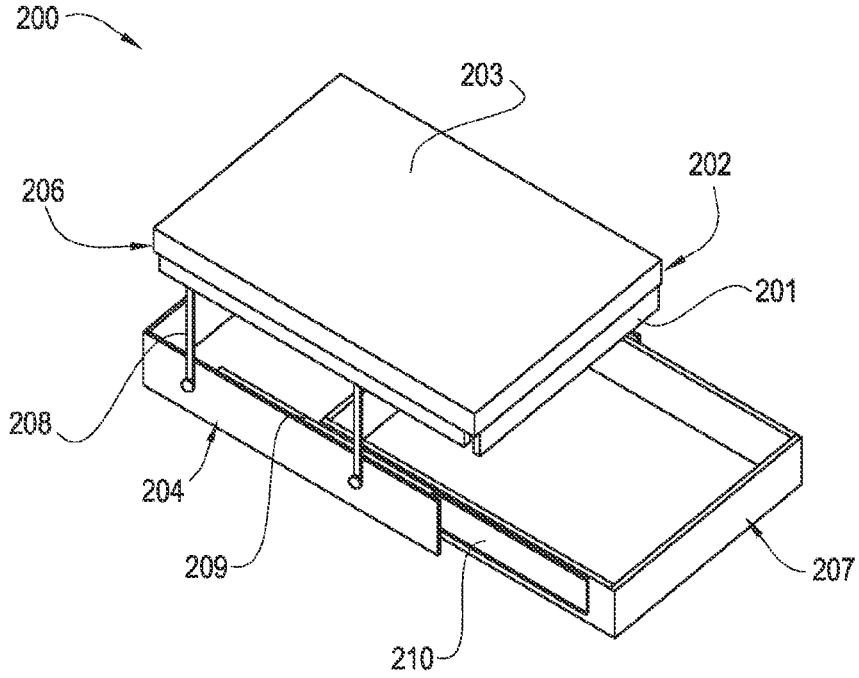
FIG. 2 depicts another embodiment of the inventive concept.

FIG. 2 depicts another embodiment of the device for concealing personal items 200. In the device 200 depicted in FIG. 2, the upper end of an articulating arm 208 may be connected to a support 206. The support 206 may be a table skirt, table apron 202, tabletop 203, or the like. In a possible embodiment, the support 206 may be a metal flange attached to a table skirt, table apron 202, tabletop 203, or the like. The lower end of an articulating arm 208 may be connected to the drawer cradle 204, either directly or through a metal flange. The release 201 may maintain the drawer cradle in the deactivated position. When the release 201 is activated, gravity, weight, or position of the device 200 may operate to swing the drawer cradle 204 into the activated position, as shown in FIG. 2. When in the activated position, the drawer 207 may extend away from the drawer cradle 204 to provide access to the contents of the drawer 207.

As can be seen in FIG. 2, a drawer 207 may be located within the drawer cradle 204. An outside drawer slide 209 may be securely connected to the inner portion of the drawer cradle 204. This outside drawer slide 209 may interlock with an inside drawer slide 210 that may be connected to the drawer 207. The inside drawer slide 210 may be secured to the drawer 207. The interconnection of the inside drawer slide 210 and the outside drawer slide 209 may allow the drawer 207 to move laterally with respect to the drawer cradle 204. This movement may allow the drawer 207 to move into and out of the drawer cradle 204. When the drawer cradle 204 is in the activated position, the drawer 207 may be fully extended away from the drawer cradle 204. When the drawer cradle 204 is in the deactivated position, the drawer 207 may be retracted into the drawer cradle 204. The drawer 207 may move to the fully extended position when the release 201 is activated due to the weight or position of the drawer 207, drawer cradle 204 or drawer slide 210, 209.

The drawer 207 may extend beyond the drawer cradle 204 to provide access to articles contained within the drawer 207 when the drawer 207 is in the activated position.

Figure 3:
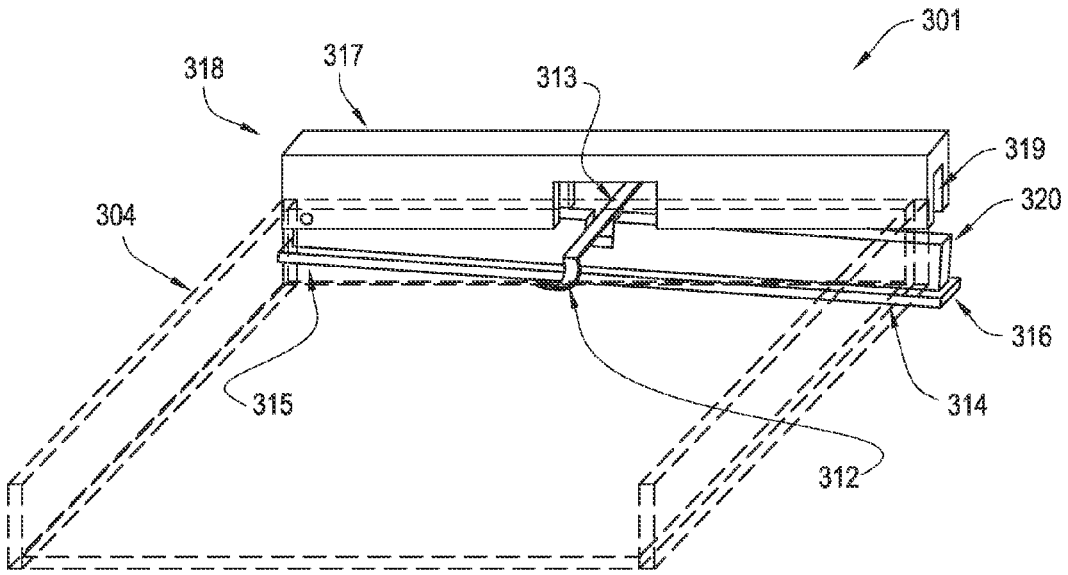
FIG. 3 depicts one embodiment of the release.

FIG. 3 depicts one embodiment of the release 301. In this embodiment, there is a latch 312 that has a latch release 313. When the latch release 313 is activated, the latch 312 may release the drawer cradle 304 and allow the drawer cradle 304 to move into the activated position. A user triggering an actuator 314 may cause the actuator 314 to activate the latch release 313. When the latch release 313 is activated, the latch 312 may move to a position that releases the drawer cradle 304 and allows the front side of the drawer cradle 304 to move away from the release 301.

The actuator 314 may be an elongated member as depicted in FIG. 3. In such an embodiment, the actuator may have an actuator pivot end 315 and an actuator trigger end 316. The actuator 314 may be connected at the actuator pivot end 315 to an actuator guide 317 at the actuator guide pivot end 318 of the actuator guide 317. The actuator guide 317 may be an elongated member with a channel 319 disposed down the length of the actuator guide 317. In some embodiments, the actuator guide 317 may be an elongated member with two downward facing essentially planar faces. One downward facing essentially planar face may be disposed lower on the actuator guide 317 than the other downward facing essentially planar face. The actuator 314 may be an elongated member with a protrusion 320 that fits within the channel 319 of the actuator guide 317. In some embodiments, the protrusion 320 may contact or come in close proximity to the higher downward facing essentially planar face. The latch 312 may be disposed on the actuator guide 317 such that when the actuator trigger end 316 is moved toward the actuator guide 317, the latch release 313 is depressed causing the latch 312 to release the drawer cradle 304 and allowing the drawer cradle 304 to move into the activated position. The protrusion 320 may depress the latch release 313. The drawer cradle 304 may be returned to the deactivated position by moving the drawer cradle 304 toward the latch 312 and causing the latch 312 to catch the drawer cradle 304.

The actuator 314 may be attached to the actuator guide 317 in a configuration that allows the protrusion 320 to enter the channel 319 when the actuator trigger end 316 is depressed toward the actuator guide 317. The height of the actuator guide 317 may be shorter at the trigger end than it is at the actuator guide pivot end 318. This may allow the outer sides of the actuator guide 317 and actuator 314 to be substantially parallel to one another when the release is in its nominal, deactivated position while allowing the actuator 314 to come into contact with and activate the latch release 313 when the actuator trigger end 316 is depressed. When the actuator trigger end 316 is depressed, the actuator 314 may pivot about the connection to the actuator guide pivot end 318. In some embodiments, the protrusion 320 height may be shorter at the actuator trigger end 316 than at the actuator pivot end 315. The height differences in the actuator 314 and actuator guide 317 ends may be gradual and decrease substantially linearly from one end of the device to the other.

Figure 4:
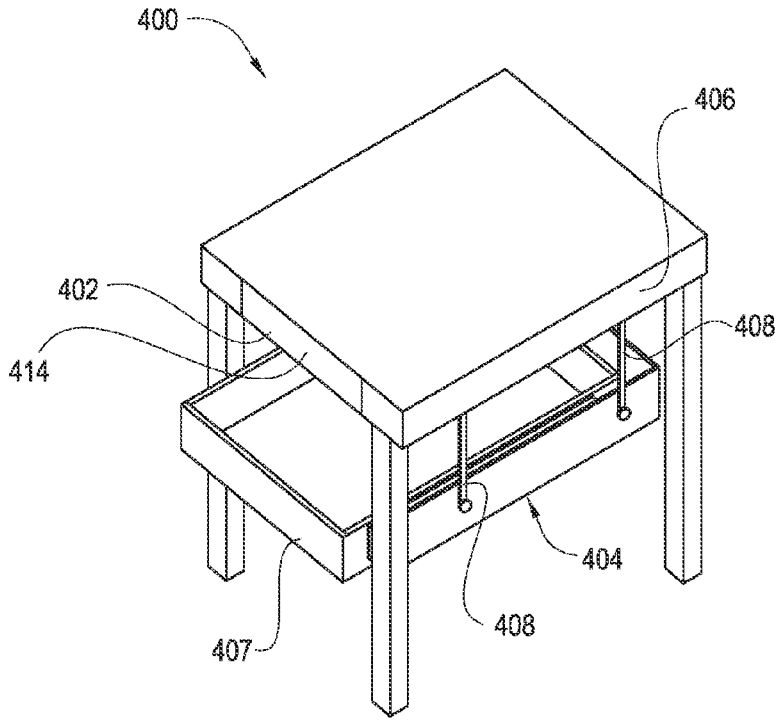
FIG. 4 depicts yet another embodiment of the inventive concept.

In some embodiments of the device for concealing personal items 400, as depicted in FIG. 4, the device may be incorporated into a table, night stand, bookshelf, chest, dresser, or the like. In such an embodiment, a table apron 402 may include trim pieces that are viewable to the casual observer of the table. One or more of the trim pieces may be utilized as the actuator 414. In such an embodiment, the actuator 414 may be located to the side, rear, or front of the device 400. In embodiments in which the actuator 414 is located to the side or rear of the device 400, a user standing in front of the actuator 414 when depressing the actuator 414 may be prevented from being struck by the drawer 407 or the drawer cradle 404 when the device moves to the activated position.

In embodiments in which the actuator 414 is located on the front of the device 400, the release may capture the drawer cradle 404 above the midpoint of the side of the drawer cradle 404. In embodiments in which the actuator 414 is located on the rear of the device, the release may capture the drawer cradle 404 below the midpoint of the side of the drawer cradle 404.

In one embodiment of the invention, there may be a pair of articulating arms 408 on either side of the drawer cradle 404. Each articulating arm may be connected to a support 406 at one end and the drawer cradle 404 at the other end.

Figure 5:
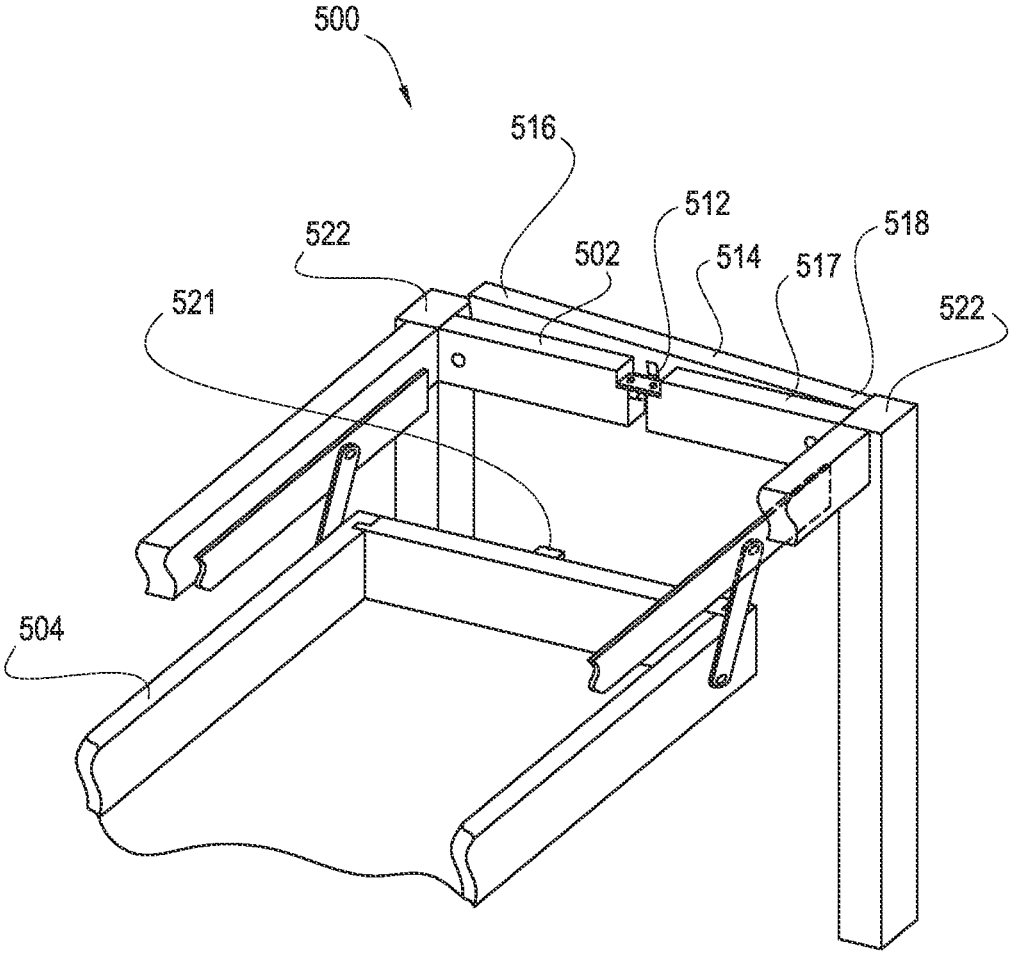
FIG. 5 depicts an embodiment of the inventive concept integrated with a table skirt.

In some embodiments, the device may operate separately from any table, table apron, or table skirt to which it may be attached. In other embodiments, the device may be integrated into a table, table apron, or table skirt to which it is attached. As depicted in FIG. 5, the device 500 is integrated into a table skirt 502. In such an embodiment, the actuator guide 517 may be comprised by the table skirt 502. The actuator guide 517 may be an elongated member with an essentially planar front side and an essentially planar back side. The latch 512 may be connected to the actuator 514 and extend through a void in the actuator guide 517 to contact a catch 521 on the drawer cradle 504 when in the deactivated position. The latch 512 may release the catch 521 when the actuator 514 is activated. Releasing the catch 521 may allow the device 500 to move to the activated position, as shown in FIG. 5. The actuator 514 may be comprised by a piece of trim that is disposed on the outer surface of the table. The actuator 514 may connect to the actuator guide 517 at the actuator guide pivot end 518. The actuator may move vertically at the actuator trigger end 516. The actuator 514 may be comprised by all or a portion of a trim piece extending the length of the table. In embodiments in which the actuator is comprised by essentially the entire portion of a trim piece extending the length of the table, the actuator ends may be received behind the table legs 522.

The foregoing examples have been provided in the interest of clarity to illustrate an embodiment of the present invention in substantial detail. A person of skill in the art will appreciate that other embodiments of the device are possible. As examples, and without the intent to be limiting, additional structures may incorporate the concealed drawer. Other structures for constructing the release are possible.

A person of skill in the art will appreciate additional embodiments that would be included within the scope and spirit of the present invention, after having the benefit of this disclosure. Furthermore, a skilled artisan will appreciate that the operations described above, along with additional operations that would be apparent to those in the art, may be performed exclusively, incrementally, sequentially, simultaneously, or any other operative configuration.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A device for concealing personal items comprising:
a release;
a drawer cradle having an activated position and a deactivated position;
a support;
a pivot fixedly connected to the support and rotatably connected to the drawer cradle;
a latch, further comprising a latch release, wherein the latch release may be activated;
an actuator, further comprising an actuator pivot end and an actuator trigger end; and
an actuator guide, further comprising an actuator guide pivot end;
wherein when the release is activated gravity operates to rotate the drawer cradle about the pivot;
wherein the actuator pivot end is pivotally connected to the actuator guide pivot end;
wherein the latch release is positioned between the actuator and the actuator guide;
wherein when the drawer cradle is in the deactivated position and the latch release is activated, gravity will operate to move the drawer cradle to the activated position; and
wherein moving the actuator trigger end toward the actuator guide activates the latch release.

2. The device according to claim 1 further comprising:
an outside drawer slide;
an inside drawer slide; and
a drawer;
wherein the outside drawer slide is fixedly connected to the drawer cradle;
wherein the drawer is fixedly connected to the inside drawer slide;
wherein the inside drawer slide is secured to the outside drawer slide;
wherein the inside drawer slide is extensible with respect to the outside drawer slide; and
wherein gravity operates to extend the inside drawer slide away from the outside drawer slide when the release is activated.

3. A device according to claim 2 further comprising:
a table apron having an inside and an outside wherein the table apron further comprises the support.

4. The device according to claim 1 further comprising:
a dampener;
wherein the dampener is fixedly connected to the support; and
wherein the dampener contacts the drawer cradle when the drawer cradle is in the activated position.

5. The device according to claim 1 further comprising:
a table apron having an inside and an outside wherein the table apron further comprises the support.

6. The device according to claim 5 wherein the table apron further comprises the release.

7. A device for concealing personal items comprising:
a release;
a plurality of articulating arms, wherein each of the plurality of articulating arms comprise an upper end and a lower end;
a support wherein each upper end of each plurality of articulating arms is rotatably connected to the support;
a drawer cradle, wherein each lower end of each plurality of articulating arms is rotatably connected to the drawer cradle, wherein the drawer cradle may be in an activated position or a deactivated position;
a latch, further comprising a latch release, wherein the latch release may be activated;
an actuator, further comprising an actuator pivot end and an actuator trigger end; and
an actuator guide, further comprising an actuator guide pivot end;
wherein the release may be actuated to allow the plurality of articulating arms to position the drawer cradle in the activated position;
wherein the actuator pivot end is pivotally connected to the actuator guide pivot end;
wherein the latch release is positioned between the actuator and the actuator guide;
wherein when the drawer cradle is in the deactivated position and the latch release is activated, gravity will operate to move the drawer cradle to the activated position; and
wherein moving the actuator trigger end toward the actuator guide activates the latch release.

8. The device according to claim 7 further comprising:
an outside drawer slide;
an inside drawer slide; and
a drawer;
wherein the outside drawer slide is fixedly connected to the drawer cradle;
wherein the drawer is fixedly connected to the inside drawer slide;
wherein the inside drawer slide is secured to the outside drawer slide; and
wherein the inside drawer slide is extensible with respect to the outside drawer slide.

9. The device according to claim 7 further comprising:
a table apron having an inside and an outside wherein the inside of the table apron further comprises the support.

10. The device according to claim 7 further comprising:
a table apron further comprising a plurality of trim pieces wherein the release further comprises the plurality of trim pieces.

11. A device for concealing personal items comprising:
a release;
a first articulating arm having a first upper end and a first lower end;
a second articulating arm having a second upper end and a second lower end;
a third articulating arm having a third upper end and a third lower end;
a fourth articulating arm having a fourth upper end and a fourth lower end;
a support further comprising a first fixed point, a second fixed point, a third fixed point, and a fourth fixed point;
a drawer cradle having a first attachment point, a second attachment point, a third attachment point, and a fourth attachment point;
a latch, further comprising a latch release, wherein the latch release may be activated;
an actuator, further comprising an actuator pivot end and an actuator trigger end; and
an actuator guide, further comprising an actuator guide pivot end;
wherein the first upper end is rotatably connected to the first fixed point;
wherein the second upper end is rotatably connected to the second fixed point;
wherein the third upper end is rotatably connected to the third fixed point;
wherein the fourth upper end is rotatably connected to the fourth fixed point;

wherein the first lower end is rotatably connected to the first attachment point;

wherein the second lower end is rotatably connected to the second attachment point;

wherein the third lower end is rotatably connected to the third attachment point;

wherein the fourth lower end is rotatably connected to the fourth attachment point;

wherein the drawer cradle may be in an activated position or a deactivated position;

wherein the release may be actuated to allow the first articulating arm, the second articulating arm, the third articulating arm, and the fourth articulating arm to position the drawer cradle in the activated position;

wherein the actuator pivot end is pivotally connected to the actuator guide pivot end;

wherein the latch release is positioned between the actuator and the actuator guide;

wherein when the drawer cradle is in the deactivated position and the latch release is activated, gravity will operate to move the drawer cradle to the activated position; and wherein moving the actuator trigger end toward the actuator guide activates the latch release.

12. The device according to claim 11 further comprising:

an outside drawer slide;

an inside drawer slide; and a drawer;

wherein the outside drawer slide is fixedly connected to the drawer cradle;

wherein the drawer is fixedly connected to the inside drawer slide;

wherein the inside drawer slide is secured to the outside drawer slide; and wherein the inside drawer slide is extensible with respect to the outside drawer slide.

13. The device according to claim 12 further comprising:

a table apron having an inside and an outside;

wherein the support further comprises the inside of the table apron;

wherein the table apron further comprises a plurality of trim pieces; and wherein the release further comprises the plurality of trim pieces.

14. The device according to claim 11 further comprising:

a table apron having an inside and an outside wherein the inside of the table apron further comprises the support.

15. The device according to claim 11 further comprising:

a table apron having an inside and an outside;

wherein the support further comprises the inside of the table apron;

wherein the table apron further comprises a plurality of trim pieces; and wherein the release further comprises the plurality of trim pieces.

* * * * *